US006820554B2

(12) United States Patent
Glöckner et al.

(10) Patent No.: US 6,820,554 B2
(45) Date of Patent: Nov. 23, 2004

(54) METHODS AND DEVICES FOR OPERATING A PRESSURE UNIT

(75) Inventors: Erhard Herbert Glöckner, Eibelstadt (DE); Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 40 days.

(21) Appl. No.: 10/471,292

(22) PCT Filed: Mar. 6, 2002

(86) PCT No.: PCT/DE02/00805

§ 371 (c)(1),
(2), (4) Date: Sep. 22, 2003

(87) PCT Pub. No.: WO02/074540

PCT Pub. Date: Sep. 26, 2002

(65) Prior Publication Data

US 2004/0060462 A1 Apr. 1, 2004

(30) Foreign Application Priority Data

Mar. 20, 2001 (DE) ..... 101 13 338

(51) Int. Cl.[7] ..... B41F 1/34

(52) U.S. Cl. ..... 101/485; 101/181; 101/216; 101/248

(58) Field of Search ..... 101/485, 175, 101/177, 181, 183, 216, 232, 248

(56) References Cited

U.S. PATENT DOCUMENTS

| | | | | | |
|---|---|---|---|---|---|
| 3,832,944 | A | * | 9/1974 | Köerner | 101/183 |
| 4,072,104 | A | | 2/1978 | Schaffer | |
| 4,919,047 | A | * | 4/1990 | Inouye et al. | 101/75 |
| 5,373,785 | A | * | 12/1994 | Yamamoto et al. | 101/116 |
| 5,558,021 | A | * | 9/1996 | Erhard | 101/232 |
| 5,706,725 | A | * | 1/1998 | Kolbe et al. | 101/216 |
| 6,227,109 | B1 | * | 5/2001 | Inoue et al. | 101/177 |
| 6,354,202 | B1 | * | 3/2002 | Heller | 101/148 |
| 6,408,748 | B1 | | 6/2002 | Hajek et al. | |
| 6,460,455 | B1 | * | 10/2002 | Eltner et al. | 101/148 |

FOREIGN PATENT DOCUMENTS

| | | |
|---|---|---|
| DE | 24 36 199 A1 | 2/1975 |
| DE | 44 30 693 A1 | 3/1996 |
| DE | 195 01 243 A1 | 7/1996 |
| DE | 195 27 199 A1 | 1/1997 |
| WO | WO 00/41887 | 7/2000 |

* cited by examiner

*Primary Examiner*—Eugene H. Eickholt
(74) *Attorney, Agent, or Firm*—Jones, Tullar & Cooper PC

(57) ABSTRACT

A printing unit is comprised of at least one counter-pressure cylinder and a transfer cylinder. A printing point is formed between the two cylinders when they are in contact. The counter-pressure cylinder is actuated by one drive motor independently of the transfer cylinder. In a print-on position, the counter-pressure cylinder is adjusted as a guide variable in relation to the power of the motor which drives the cylinder.

42 Claims, 3 Drawing Sheets

METHODS AND DEVICES FOR OPERATING A PRESSURE UNIT

FIELD OF THE INVENTION

The present invention is directed to methods and devices for operating a printing unit. At least one counter-pressure cylinder and one transfer cylinder constitute a printing position. The cylinders are driven at controlled speeds.

BACKGROUND OF THE INVENTION

In the course of driving cylinders or groups of cylinders by the use of separate drive mechanisms, for example in satellite printing units, process-related unwinding differences between the pairs of cylinders can occur. These unwinding differences are dependent on the cylinder contact pressure, on the number of active printing positions, on the thickness of the dressings carried by the cylinders, on the type of cylinders, or even on the producer, or source of the dressing itself, whether the friction gear is embodied without or with bearer rings, on the radii of the bearer rings, or on the radius ratios of the friction gear as a whole.

This unwinding difference can result, in part, in considerable and, with changing conditions, in considerably varying output effects between the cylinders, or groups of cylinders. This is undesirable, since it results in asymmetries in the output layout, in different outputs, depending on the conditions and modes of operation, or even in overloads of the motors and regulators.

Cylinders of a rotary printing press with bearing rings are known from DE 195 01 243 A1. The bearing rings of the satellite cylinder are rotatably seated for the purpose of reducing the output transfer.

In WO 00/41887 A1, a compensating friction gear, in the form of bearing rings of reversed radius ratios, is superimposed on a friction gear with cylinders which are in process-related frictional contact. The normal force between the cylinders placed against each other is set in such a way that a value of a difference between the power consumption of the motors driving the cylinders is minimal.

DE 195 27 199 A1 shows a drive mechanism for a printing unit. A forme cylinder can be driven at varying circumferential speeds as a function of a contact of the printing forme with a counter-pressure cylinder. A circumferential speed, which differs from that of the counter-pressure cylinder, occurs in a phase of the cylinder rotation in which there is no printing contact between the forme and the counter-pressure cylinder.

SUMMARY OF THE INVENTION

The object of the present invention is directed to providing methods and devices for operating a printing unit.

In accordance with the invention, these objects are attained by driving a printing unit, which includes at least one counter-pressure cylinder and one cooperating transfer cylinder, in a manner such that the speeds of the two cylinders may be different. The counter-pressure cylinder is driven by a drive motor. The speed of the counter-pressure cylinder may be varied as a function of the absorbed output or of the electrical output of that drive motor. A deviation between the speeds of the two cylinders may be sensed [means of the characteristics of claim 1, 3, 5 or 12, and 13, 14 or 22].

The advantages which can be obtained by the invention consist, in particular, in that a sufficiently good unwinding of the printing cylinders takes place, which unwinding is, to a large extent, a function of the contact pressure and/or of the number of the active printing positions, or of the thickness of the dressing and/or the type or the manufacturer of the dressing. With changing configurations of the printing positions and/or the dressings, and in particular with changing configurations of the printing blankets on the transfer cylinders, the print quality is not, or is only slightly, reduced.

In principle, it is possible to determine a suitable defined difference in the cylinder circumferential speeds at different modes of operation and/or for various dressings, which defined differences can be stored in a memory, for example, and, depending on the mode of operation/or dressing, can be forced on and maintained during production.

A minimization of the fluctuation range of the motive or of the generative output of the drive motor takes place in an advantageous manner by the regulation, in accordance with the present invention, of the leading or of the trailing of the rpm, or of the circumferential speed, of at least one of the cylinders with respect to at least one oppositely located cooperating second cylinder as a function of the output of the drive motor, either produced or received, via the friction gear.

The above mentioned regulation can be employed, in particular, in connection with printing units in which several transfer cylinders form printing positions with so-called satellite cylinders. For example, this regulation can be used in 5-cylinder printing units, in 9-cylinder satellite printing units, or in 10-cylinder satellite printing units.

The employment of the regulation is particularly advantageous for printing units with cylinders which roll off one another without the use of bearing rings. The satellite cylinder is operated in a leading or trailing manner, which manner of operation is a function of the power consumption, or of the output, of the drive motor assigned to it, with respect to the transfer cylinder cooperating with it. In the case of cylinders without bearing rings, the output is transferred exclusively by the cylinders themselves rolling off on each other. In case of a change of the configuration of a cylinder, in particular when changing the dressings on the transfer cylinders, for example dressings in the form of printing blankets with different conveying properties, which are so-called negatively, neutrally or positively conveying printing blanket, the required generative or motive output at the satellite cylinder is maintained within narrow limits by use of the regulation. In this way, an excess size of regulation and/or the danger of overloading regulating device and drive motors is reduced.

However, the regulation is also suitable for printing units with bearing rings which roll off on each other. In this case, a slippage between the bearing rings within defined limits, as discussed subsequently, is permitted.

In order to maintain a desired print quality, selectable lower or upper limits of the deviation of the number of revolutions, or of the circumferential speed of the satellite cylinder, from the circumferential speed of the cooperating transfer cylinders, are not downwardly or upwardly exceeded. This occurs simultaneously with the reduction of the generative or motive output at the satellite cylinder. The satellite cylinder is driven within these limits at its minimum absolute output, either generative or motive. These deviation limits can each be variously selected in connection with various materials to be imprinted, with various printing methods and with various demands made on quality. They range, for example for newspaper printing, at a deviation of ±0.01% to ±0.05% from the production, or circumferential speed of the cooperating cylinders.

This speed regulation is advantageous for printing units whose cylinders are driven in groups or which are driven individually by several mechanically unconnected drive motors. Such regulation is advantageous, for example, for 9-or 10-cylinder satellite printing units with one drive motor each per cylinder, for 9-or 10-cylinder satellite printing units with one drive motor for each forme cylinder-transfer cylinder pair and the satellite cylinder(s), and also for 9-or 10-cylinder satellite printing units with one drive motor each for each group of forme cylinder-transfer cylinder pairs.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
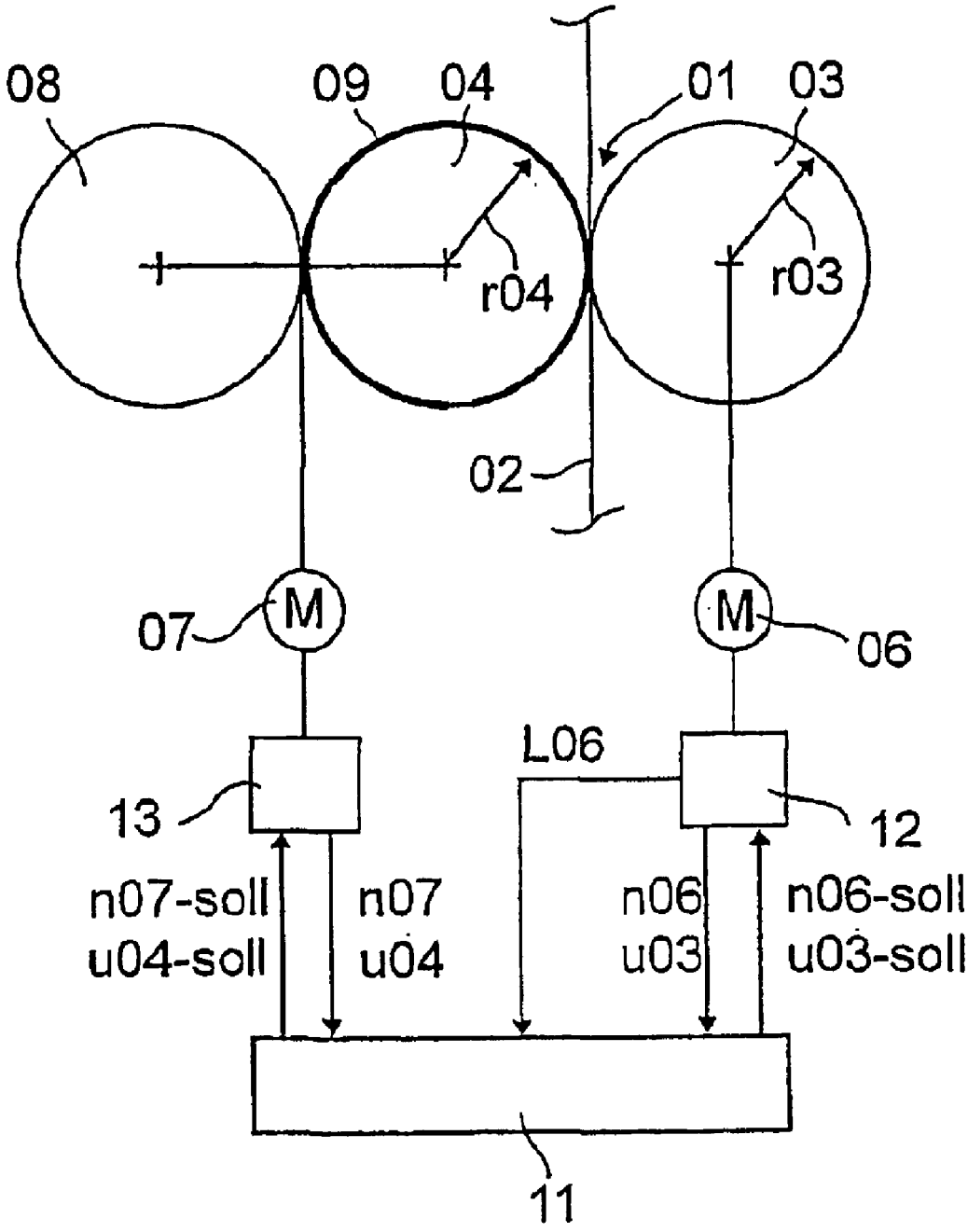
FIG. 1, a schematic representation of cooperating cylinders of a rotary printing press in accordance with the present invention, in FIG. 2, a schematic representation of a 9-cylinder satellite printing unit, and in FIG. 3, a schematic representation of a 10-cylinder satellite printing unit.

A rotary printing press, as depicted in FIG. 1, has a printing position 01 with two cylinders 03, 04, which, in a print-on position, work together through a web 02, for example a web 02 of material to be imprinted, in particular a paper web 02. In the printing press depicted in FIG. 1, the cylinders 03, 04 are embodied without bearing rings and constitute a friction bearing because of their jacket surfaces which roll off on each other. The first cylinder 03 is embodied as a counter-pressure cylinder 03, for example as a steel cylinder 03, and during letterpress or flexographic printing counter-pressure cylinder 03 can be driven directly or indirectly by a first drive motor 06. Counter-pressure cylinder 03 is driven independently of the second cylinder 04, which is, for example, a transfer cylinder 04, or a printing block cylinder 04.

The second cylinder 04, which is, for example, embodied as a transfer cylinder 04, can also be driven directly or indirectly, for example via a gear, that is not specifically represented, for example through a gear wheel, a toothed belt or a friction gear, by a second drive motor 07. The transfer cylinder 04 can be driven individually, or can be driven, together with a third cylinder 08 working together with it, for example a forme cylinder 08, or an inking or dampening unit, which is not specifically represented. In the printing press shown in FIG. 1, the transfer cylinder 04 can be driven together with the forme cylinder 08 by use of the drive motor 07, as is depicted schematically in FIG. 1.

On its jacket, the second cylinder 04 has a dressing 09, in the form of, for example, a printing blanket 09, a rubber blanket 09 or a printing block 09. Dressing 09 is the means by which the ink is applied to the paper web 02.

In the embodiment of the present invention shown in FIG. 1, the counter-pressure cylinder 03 is embodied with a radius r03, and the transfer cylinder 04 with a radius r04, with both cylinders 03, 04 being of a so-called double circumference, i.e. with each having a circumference corresponding to two vertical or to two horizontal printed pages, for example to two horizontal or vertical newspaper pages. In order to counteract a distortion or a displacement of the printed image, which may, for example, be caused by flexing of the dressing 09, the radius r03 of the counter-pressure cylinder 03 is designed to be larger by 0.2 to 1 per thousand than the radius r04 of the transfer cylinder 04.

However, cylinders 03, 04 can be embodied as both with the same, single circumference or, for example, the transfer cylinder 04 can be configured with a single, and the counter-pressure cylinder 03 with double circumference. The width of each of the cylinders 03, 04, 08 can be single, double, triple or quadruple.

In customary methods, the drive of the cooperating cylinders 03, 04, 08 takes place in such a way that the circumferential speeds u03, u04 of the cylinders 03, 04, 08 are almost identical. As a rule, when using several drive motors 07, 06, which are not mechanically coupled with each other, this speed control is accomplished by the use of an rpm regulation, and via an "electronic shaft", i.e. by the use of electrical synchronization.

However, a strong mechanical coupling takes place between the cylinders 03, 04, 08, in particular in connection with cylinders 03, 04 without bearing rings, which strong mechanical coupling is greatly dependent on the type of the dressings 09, the properties of these dressings 09, and on the number of cylinders, such as transfer cylinders 04 which are placed against a counter-pressure cylinder 03. For example, rubber blankets or dressings 09 of different types or from different producers show very different conveying properties when rolling off on the jacket of the counter-pressure cylinder 03.

At the same circumferential speed u04, u03, or motor rpm n07, n08, so-called negatively conveying rubber blankets 09 on the transfer cylinder 04 have a tendency for braking the counter-pressure cylinder 03, while so-called positively conveying rubber blankets 09 tend to accelerate the counter-pressure cylinder 03 in Rs direction of rotation. In the first case, the operation of the drive motor 08 for the counter-pressure cylinder 03 requires an increased motor output, and in the second case the drive motor 08 for the counter-pressure cylinder 03 requires an increased generating or braking output.

A regulation of the cylinders, or of the motors to identical circumferential speeds u03, u04, or to identical motor rpm n06, n07, or to a fixed relative angle of rotation position, does not solve the problem if these conditions change.

As schematically represented in FIG. 1, the circumferential speeds u03, u04 of the cylinders 03, 04, or the rotational speeds or rpm n06, n07 of their drive motors 06, 07, are picked up and are provided to a control device 11. Detection of these speeds can take place through the use of separate angle encoders, of encoders internal to the motor, or in any other way. In addition, at least the output L06 of the drive motor 06 at the counter-pressure cylinder 03 is picked up and is provided to the control device 11.

The control device 11 can be embodied in various ways, so that, for example, each one of the drive motors 06, 07 will have its own drive control 12, 13, which is assigned a desired value n06-soll, n07-soll for a circumferential speed u03, u04 at the cylinders 03, 04, or motor rpm n06, n07 corresponding to the cylinder 08, through the control device 11. However, the respective drive control for each motor can also be integrated into the control device 11. The evaluation of the rpm n06, n07 and the assignment of desired values n06-soll, n07-soll can take place by use of suitable software in a computer, in the control console, or in a module of an SPS by the provision of programming or hardware.

At the start of production of the rotary printing press depicted in FIG. 1, the drive motors 06, 07 are regulated to desired values n06-soll, n07-soll of their rotational speeds or rpm by the use of feedback of the actual values of the rotational speeds or rpm n06, n07 as the command variable. This regulation is accomplished in such a way that the circumferential speeds u03, u04 of the cooperating cylinder 03, 04 are almost identical.

With print-on, i.e. when the two cylinders 03, 04 are in printing contact with each other, the circumferential speed u03 of the counter-pressure cylinder 03 is varied in such a way that the size of the output L06 of the drive motor 06 becomes less and, in the ideal case, assumes a minimum value. A change of the relative circumferential speeds u03, 04, or changes in the relative angular position, are intentionally permitted. This is independent of the passage of a printed image through the nip location. Instead, it generally takes place during printing contact. Now the output L06 is used as the command variable for regulating the circumferential speed u03, or the rpm n06. Based on the use of the output L06 as the command variable, a changed desired value of the circumferential speed u03-soll, or of the rpm n06-soll, for example, can be established and assigned.

In principle, it is also possible to store suitable differences of the circumferential speeds u03, u04 for various operational situations and/or for different dressings 09, which are then maintained by the use of drive motors 06, 07, which are angle-or rpm-controlled.

The variation of the rotational speed or rpm n06 of the first drive motor 06 takes place under the condition that the circumferential speed u03 of the counter-pressure cylinder lies maximally below, or is trailing the circumferential speed u04 of the cooperatively acting cylinder 04, or of the production speed $u_p$,by a deviation Δ u1, for example Δ u1=−0.01% to −0.05%, or is above, or leading the circumferential speed u04 of the cooperatively acting cylinder 04, or the production speed up, by maximally Δ u2, for example Δ u2=+0.01 to +0.05%. For this reason, monitoring of the rpm n06, or the circumferential speed u03, is continued and compared with the rpm n07, or the circumferential speed u04 of the second cylinder 04. This is monitored to determine whether the relative deviation Δ u of the circumferential speed u03 from the circumferential speed 04 still lies within the above mentioned interval.

The following applies regarding the regulation during production and/or in the print-on position:

$$|L06(\Delta u)|' = \mathrm{Min}_{local} \text{ for all } \left\{\Delta u \,\middle|\, \Delta u1 \le \frac{\Delta u}{u04} \le \Delta u2\right\}$$

wherein Δ u=(u03−u04).

Thus the regulation of the drive motor 06 to obtain identical, constant rpm n06 or n07, or identical circumferential speeds u03 and u04 does not primarily take place. Regulation follows an rpm n06 along a drop in the output L06 as a function of the deviation Δ u between the resulting circumferential speed u03 and the circumferential speed u04, or of the production speed $u_p$ (for 04=$u_p$) of the cooperatively acting cylinder 04.

A relative minimum for the generative or motive output L06 can lie in the rpm range permitted for the variation, which corresponds to the interval Δ u1, Δ u2 for the permissible relative deviation from the circumferential speeds u03, u04. But possibly there can also only be a monotone dropping or rising dependency in the permitted interval Δ u1, Δ u2 between the output L06 and the deviation from the circumferential speed u03, u04, so that the rpm n06, and therefore the circumferential speed u06 in the respective operational state takes on the maximally permissible upward or downward deviation Δ u. In this way the generative, or motive output L06 in the permitted interval is minimized for the deviation Δ u in this case, too. When the limit value Δ u1, Δ u2 has been reached, regulation of the drive of the first cylinder 03 in this case takes place by use of the rpm n06, or of the circumferential speed u03 as the command variable. The rpm n06 is maintained at this limit value Δ u1, Δ u2 as long as it is not possible to leave the limit value Δ u1, Δ u2 in the permitted direction because of new conditions, for example in the dependency of the output L06.

If, for example, the transfer cylinder 04 has a dressing 09 which is negatively conveying, so that it "brakes" the counter-pressure cylinder 03, the motive output L06 at the drive motor 06 is increased after reaching the circumferential speed u03, u04, or of the production speed $u_p$ of the cylinders 03, 04, and the print-on position. Now the rpm n06, or the circumferential speed u03 of the counter-pressure cylinder 03 is reduced until either a local minimum or the lower limit value Δ u1 for the deviation Δ u from the circumferential speed u04 of the second cylinder 04, or of the production speed $u_p$, has been reached. In this case, an increase of the rpm n06 would lead to an increased absorption of motive output L06.

In the reverse situation , when using a positively conveying dressing 09, the drive motor 06 is provided with an additional torque via the frictional gearing of the cylinders 03, 04 following the placement of the cylinders into the print-on position, and in case of a regulation to identical constant circumferential speeds u03, u04, the drive motor 06 would need an increased generative output L06. Now the rpm n06, or the circumferential speed u03 of the counter-pressure cylinder is increased until either a local minimum or the upper limit value Δ u2 for the deviation Δ u from the circumferential speed u04 of the second cylinder 04, or of the production speed $u_p$, has been reached. In this case a decrease of the rpm n06 would lead to a further increased absorption of generative output L06.

Such a regulation in respect to the minimal motive, or generative output L06 can be embodied so it is preset manually or, in an advantageous embodiment, is self-adaptive. The limit values Δ u1, Δ u2 are a function of the printing press, the material to be imprinted, the demands made on the printing result and the configuration of the printing press, and can be preset in the form of programs which are fixedly stored in the control device 11 and which are possibly selectable, or via an input arrangement.

With newspaper printing on appropriate paper, the lower, or trailing limit value Δ u1, as well as the upper, or leading limit value Δ u2, lie advantageously at±0.01 to ±0.03%, and in particular are at ±0.02%, so that the following applies:

$$|L06(\Delta u)|' = \mathrm{Min}_{local} \text{ for all } \left\{\Delta u \,\middle|\, \Delta u1 \le \frac{\Delta u}{u04} \le \Delta u2\right\}$$

wherein: Δ u=(u03−u04).

In actual operations, the determination and regulation toward defined motor rotational speeds or rpm n06, n07, or cylinder circumferential speeds u03, u04, also takes place by determination of angular positions of the cylinders 03, 04, or of the drive motors 06, 07, and/or their chronological changes. In what was discussed before and what will be discussed, as follows, the determination and the regulation of the rpm n06, n07, or of the circumferential speeds u03, u04, should also be understood in the sense of determining the angular positions and a regulation in respect to the angular positions and/or their chronological changes or in their angular velocities.

A regulation in respect to identical circumferential speeds u03, u04 of two cooperating cylinders 03, 04 then corresponds, in the case of cylinders 03, 04 of equal circumference, to the correspondingly identical changes in the angular positions of the cylinders 03, 04 and/or possibly of the drive motors 06, 07. For different radii r03, r04 of the cylinders 03, 04, it is necessary in the course of the regulation, to take into consideration the chronological changes of the angular positions, or of the angular positions themselves, in respect to the radius conditions.

For a regulation wherein a relative deviation Δ u from the circumferential speeds u03, u04 of the cylinders 03, 04 is permissible, or is intentionally caused, in this mode of operation the regulation to identical angular positions and/or to their chronological changes is suspended, at least for the drive mechanism of one of the cylinders 03, 04. The other cylinder 03, 04, however, can be synchronized with respect to other cylinders, to printing units and/or units of the printing press, i.e. regulated to identical circumferential speeds u03, u04, or to corresponding angular positions, to maintaining a defined relative angular position, and/or identical chronological changes in the angular positions.

Figure 2:
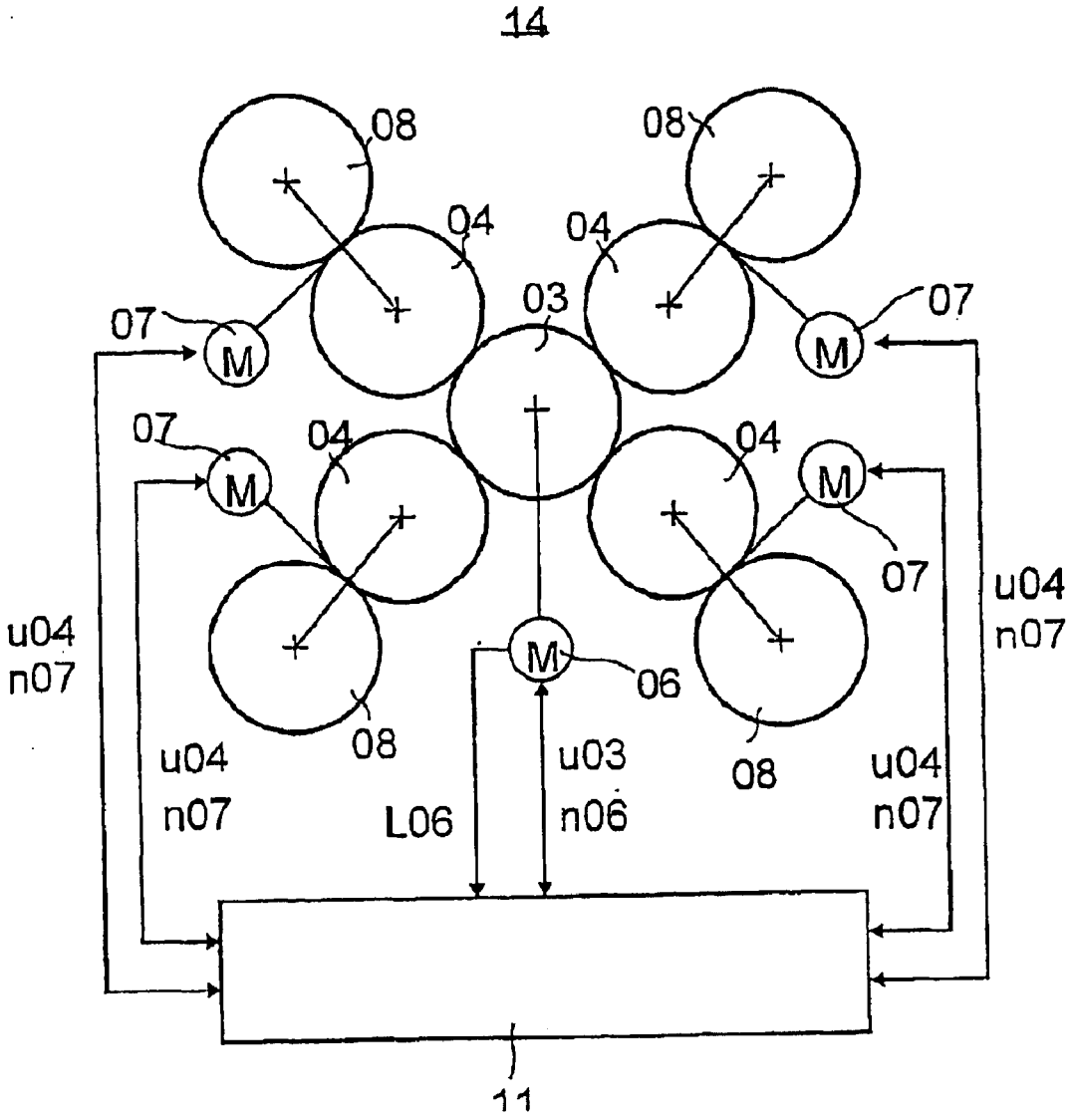

A 9-cylinder satellite printing unit 14 with four possible printing positions 01, in accordance with the present invention, is represented in FIG. 2. A paper web can be imprinted in a print-on position, it being understood that the printing positions 01 and the paper web 02, as well as dressings 09, are not specifically represented in FIGS. 2 and 3. In contrast to FIG. 1, four transfer cylinders 04 can be placed against a counter-pressure cylinder 03, which is embodied as a satellite cylinder 03. The transfer cylinders 04 and their cooperating forme cylinders 08 can each be driven in pairs by use of the respective drive motors 07. In contrast to FIG. 1, no motor drive controls 12, 13 have been represented as being situated between the drive motors 06, 07 and the control device 11.

Depending on the number of transfer cylinders 04 in contact with satellite cylinder 03, on the type of the dressings 09; i.e. positively, negatively, neutrally conveying on each transfer cylinder 03, and the conveying behavior of the paper type used in the paper web 02, and with the satellite cylinder 03 set to a constant circumferential speed u03, or motor rotational speed or rpm n06, the generative or motive output L06 at the drive motor 06 can again fluctuate considerably.

The drive motors 07 of the transfer cylinders 04 which are in the print-on position, are regulated to a motor rotational speed or an rpm n07-soll through the output supply by use of the actual value of the motor rotational speed or rpm n07 as the command variable, which corresponds, for example, to the selected production speed up, or to the circumferential speed u04-soll of the transfer cylinders 04.

The drive motor 06 of the satellite cylinder 03 is initially, and in particular prior to the print-on position, regulated to the same circumferential speed u03=u04, for example the production speed $u_p$, by use of the preset desired value n06-soll.

After one or several transfer cylinders 04 are in the print-on position, the supply of the output L06 is no longer regulated in respect to a rpm n06-soll corresponding to the circumferential speed u04, or to the circumferential speed u03-soll, but in a reverse manner the rpm n06, or the circumferential speed u03 is regulated by use of the output L06 as the command variable in respect to a minimal motive or generative output L06 of the drive motor 06. The desired value u03-soll at the satellite cylinder 03 is changed, for example, by a relative deviation Δ u. The marginal condition must again be met, that the deviation Δ u of the circumferential speed u03 of the satellite cylinder 03 from the circumferential speed u04, or the production speed $u_p$, is not permitted to downwardly or upwardly exceed a lower, or trailing limit value Δ u1 and an upper, or leading limit value Δ u2, for example ±0.02% of the production speed $u_p$.

Figure 3:
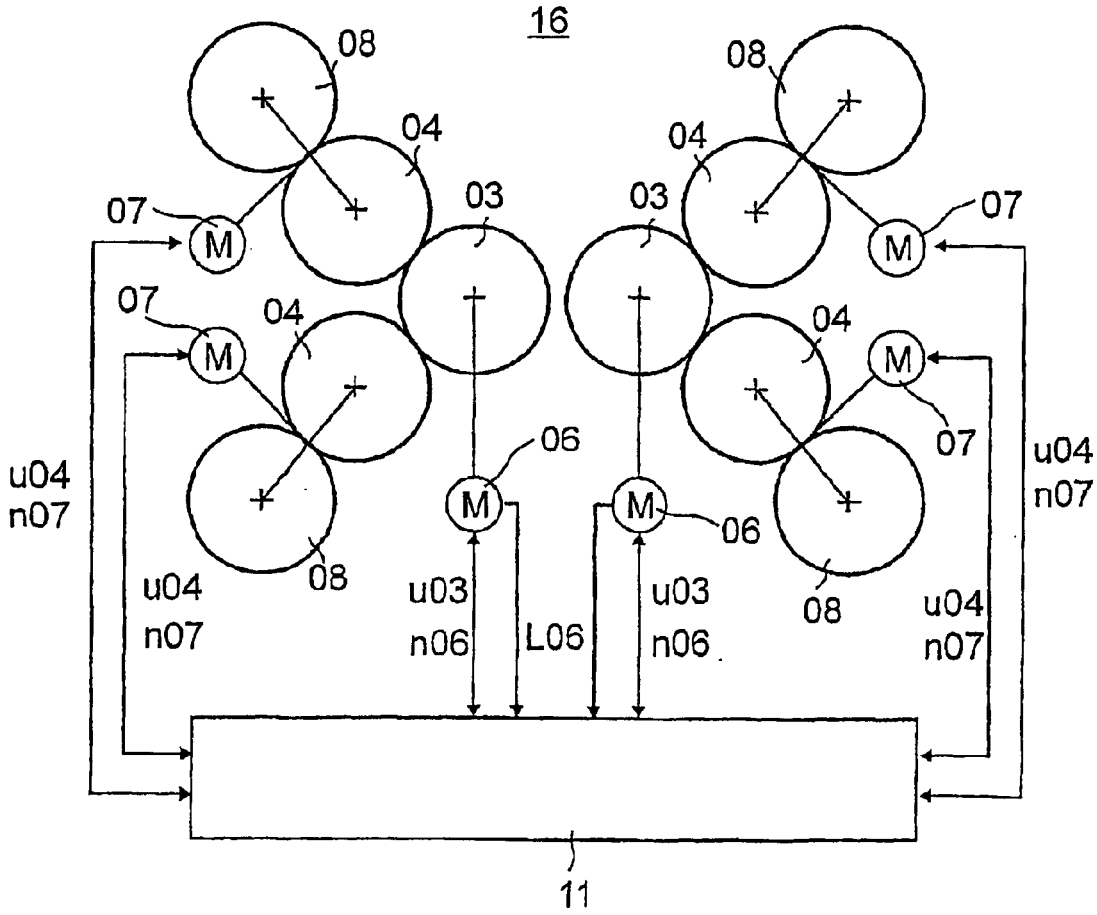

If, as represented in FIG. 3, the two satellite cylinders 03 of a 10-cylinder satellite printing unit 16 are each driven by their own drive motors 06, the regulation regarding the minimum of the output L06 of each drive motor 06 can take place individually.

The regulation can also be used for larger printing units, or printing unit systems, for example for two stacked 9-cylinder satellite printing units 14, or also for two stacked 10-cylinder satellite printing units 16. With such arrangements, and with other similar arrangements the paper web 02 can be printed in four colors on both sides or, for example, in two colors on both sides with full imprinter functionality.

If the cooperating transfer and forme cylinders 04, 08 are not driven in pairs, but each one is driven by its own drive motor 07, the regulation of the drive motors 07 for the forme cylinders 08 and for the transfer cylinders 04, in respect to their circumferential speeds u04-soll, u08-soll, or the regulation of the rpm n07-soll for the drive motor 07, is performed in accordance with the above-described preferred embodiments for the drive motors 07.

The regulation of a drive motor 06, 07 of the cylinders 03, 04 by the use of the output L06 as the command variable is not limited to the counter-pressure or satellite cylinder 03 represented in the preferred embodiments. It is also possible, in the reverse way during production, to perform a regulation of the satellite cylinders 03 by use of the actual value of the rpm n06, or of the circumferential speed u03, as the command variable to a constant rpm n06-soll, or a constant circumferential speed u03-soll, while the cooperating transfer cylinder or cylinders 04 is or are regulated to a minimum output in the respective interval by the use of an output, which is not specifically represented, as the command variable.

In the case of individually driven cylinders 03, 04, 08, the regulation of the drive motor 06 for each cylinder takes place in a way wherein the drive motor 06 substantially absorbs the same output L06 as the drive motor 07 of the cylinder 04, which, in this case, is individually driven. For this purpose, a deviation of the circumferential speed u03, u04 within the stated limits is intentionally accepted.

A high generative output L06, in particular, is avoided by use of the described regulation, without the quality of the product lying outside a tolerable range. This applies to the use of differently conveying rubber blankets 09.

While preferred embodiments of methods and devices for operating a printing unit in accordance with the present invention have been set forth fully and completely hereinabove, it will be apparent to one of skill in the art that various changes in, for example, the specific sizes of the cylinders, the types of drive motors used, the type of web being printed, and the like could be made without departing from the true spirit and scope of the present invention which is accordingly to be limited only by the following claims.

What is claimed is:

1. A method of driving a printing unit including:

providing a least one counter-pressure cylinder;

providing at least one transfer cylinder, said at least one transfer cylinder and said at least one counter-pressure cylinder constituting a printing position; and driving said at least one counter-pressure cylinder and said at least one transfer cylinder, when they are in contact with each other in said printing position, at first and second circumferential speeds different from each other.

2. The method of claim 1 further including providing a first drive motor for driving said at least one counter-pressure cylinder independently of said at least one transfer cylinder, measuring an absorbed output of said drive motor driving said at least one counter-pressure cylinder and regulating said counter-pressure cylinder in a print-on position as a function of said absorbed output.

3. The method of claim 2 further including determining an electrical output of said first drive motor and changing a circumferential speed of said at least one counter-pressure cylinder with respect to a circumferential speed of said at least one transfer cylinder as a function of said electrical output.

4. The method of claim 2 wherein said absorbed output is an electrical output whose value drops, and further sensing a relative deviation of a circumferential speed of said cylinders and of a rotational-speed of said motor and maintaining said deviation within a permissible limit.

5. The method of claim 4 further including regulating said first drive motor in response to said electrical output having a minimal value lying within an interval permissible for a relative deviation during a variation of a circumferential speed of one of said cylinders.

6. The method of claim 1 further including providing a second drive motor for said at least one transfer cylinder and regulating said at least one transfer cylinder as a function of one of a presettable motor rotational speed of said second motor and a presettable circumferential speed of said at least one transfer cylinder.

7. The method of claim 4 further including forming said relative deviation from said circumferential speeds of said cylinders using a first limit value taken in a first direction toward lower circumferential speeds of said at least one counter-pressure cylinder in comparison with said at least one transfer cylinder and a second limit value in a second direction toward greater circumferential speeds of said at least one counter-pressure cylinder in comparison with said at least one transfer cylinder.

8. The method of claim 7 wherein said first limit value is formed having a maximum deviation of −0.05% to 0.01% and in particular −0.02%.

9. The method of claim 7 wherein said second limit value is formed having a maximum deviation of +0.05% to +0.01% and in particular +0.02%.

10. A method of driving a printing unit including:

providing at least one counter-pressure cylinder;

providing at least one transfer cylinder, said at least one counter-pressure cylinder and said at least one transfer cylinder constituting a printing position;

providing a first drive motor and driving said at least one counter-pressure cylinder using said first drive motor mechanically independently of said at least one transfer cylinder; and regulating said at least one counter-pressure cylinder in a print-on position in contact with said at least one transfer cylinder as a function of an absorbed output of said first drive motor driving said counter-pressure cylinder.

11. The method of claim 10 further including determining an electrical output of said first drive motor and changing a circumferential speed of said at least one counter-pressure cylinder with respect to a circumferential speed of said at least one transfer cylinder as a function of said electrical output.

12. The method of claim 10 wherein said absorbed output is an electrical output whose value drops, and further sensing a relative deviation of a circumferential speed of said cylinders and of a rotational speed of said motor and maintaining said deviation within a permissible limit.

13. A The method of claim 12 further including regulating said first drive motor in response to said electrical output having a minimal value lying within an interval permissible for a relative deviation during a variation of a circumferential speed of one of said cylinders.

14. The method of claim 10 further including providing a second drive motor for said at least one transfer cylinder and regulating said at least one transfer cylinder as a function of one of a presettable motor rotational speed of said second motor and a presettable circumferential speed of said at least one transfer cylinder.

15. The method of claim 12 further including forming said relative deviation from said circumferential speeds of said cylinders using a first limit value taken in a first direction toward lower circumferential speeds of said at least one counter-pressure cylinder in comparison with said at least one transfer cylinder and a second limit value in a second direction toward greater circumferential speeds of said at least one counter-pressure cylinder in comparison with said at least one transfer cylinder.

16. The method of claim 15 wherein said first limit value is formed having a maximum deviation of −0.05% to 0.01% and in particular −0.02%.

17. The method of claim 15 wherein said second limit value is formed having a maximum deviation of +0.05% to +0.01% and in particular +0.02%.

18. A method of driving a printing unit including:

providing at least one counter-pressure cylinder;

providing at least one transfer cylinder, said at least one transfer cylinder and said at least one counter-pressure cylinder constituting a printing position;

providing a first drive motor;

using said first drive motor and driving said at least one counter-pressure cylinder mechanically independently of said at least one transfer cylinder;

determining an absorbed output of said first drive motor; and changing a circumferential speed of said at least one counter-pressure cylinder during printing contact between said cylinders, in relation to a circumferential speed of said transfer cylinder as a function of said electrical output.

19. The method of claim 18 wherein said absorbed output is an electrical output whose value drops, and further sensing a relative deviation of a circumferential speed of said cylinders and of a rotational speed of said motor and maintaining said deviation within a permissible limit.

20. The method of claim 19 further including regulating said first drive motor in response to said electrical output having a minimal value lying within an interval permissible for a relative deviation during a variation of a circumferential speed of one of said cylinders.

21. The method of claim 18 further including providing a second drive motor for said at least one transfer cylinder and regulating said at least one transfer cylinder as a function of one of a presettable motor rotational speed of said second motor and a presettable circumferential speed of said at least one transfer cylinder.

22. The method of claim 19 further including forming said relative deviation from said circumferential speeds of said cylinders using a first limit value taken in a first direction toward lower circumferential speeds of said at least one counter-pressure cylinder in comparison with said at least one transfer cylinder and a second limit value in a second direction toward greater circumferential speeds of said at least one counter-pressure cylinder in comparison with said at least one transfer cylinder.

23. The method of claim 22 wherein said first limit value is formed having a maximum deviation of −0.05% to 0.01% and in particular −0.02%.

24. The method of claim 22 wherein said second limit value is formed having a maximum deviation of +0.05% to +0.01% and in particular +0.02%.

25. A method of driving a printing unit including:

providing at least one counter-pressure cylinder;

providing at least one transfer cylinder, said at least one counter-pressure cylinder and said at least one transfer cylinder constituting a printing position;

providing means for driving said at least one counter-pressure cylinder and said at least one transfer cylinder at first and second circumferential speeds;

determining an acceptable deviation of said circumferential speeds in accordance with one of a mode of operation of and a dressing applied to one of said cylinders; and charging said means for driving with said deviation corresponding to said one of said mode of operation and said dressing.

26. A device for driving a printing unit comprising:

at least one counter-pressure cylinder;

at least one transfer cylinder, said at least one counter-pressure cylinder and said at least one transfer cylinder constituting a printing position;

a first drive motor having an electrical output and adapted to drive said at least one counter-pressure cylinder mechanically independently from said at least one transfer cylinder, wherein a circumferential speed of said at least one counter-pressure cylinder can be changed in relation to a circumferential speed of said at least one transfer cylinder as a function of said electrical output of said first drive motor.

27. The device of claim 26 wherein said first drive motor can be regulated in view of said electrical output whose value drops.

28. The device of claim 26 wherein said first drive motor can be regulated in view of said electrical output whose value is minimal.

29. The device of claim 27 wherein a relative deviation of said circumferential speeds lies within a permissible interval.

30. The device of claim 27 further including a permissible relative deviation of said circumferential speeds which is formed using a first limit value in a direction of slower circumferential speeds of said counter-pressure cylinder in comparison to said transfer cylinder and by a second limit value in a direction of greater circumferential speeds of said counter-pressure cylinder in comparison to said transfer cylinder.

31. The device of claim 30 wherein said first limit value is formed by a deviation of −0.05% to −0.01% and in particular −0.02%.

32. The device of claim 30 wherein said second limit value is formed by a deviation of +0.05% to +0.01% and in particular +0.02%.

33. A device for driving a printing unit comprising:

at least one counter-pressure cylinder;

at least one transfer cylinder, said counter-pressure cylinder and said transfer cylinder constituting a printing position;

a first drive motor adapted to drive said counter-pressure cylinder mechanically independently from said transfer cylinder;

an electrical output of said first drive motor; and means for changing a circumferential speed of said counter-pressure cylinder in relation to a circumferential speed of said transfer cylinder during printing contact between said cylinders as a command variable as a function of said electrical output.

34. The device of claim 33 wherein in a print-on position, said circumferential speed of said counter-pressure cylinder can be changed in relation to said circumferential speed of said transfer cylinder as a function of said electrical output.

35. The device of claim 33 wherein said first drive motor can be regulated in view of said electrical output whose value drops.

36. The device of claim 33 wherein said first drive motor can be regulated in view of said electrical output whose value is minimal.

37. The device of claim 35 wherein a relative deviation of said circumferential speeds lies within a permissible interval.

38. The device of claim 35 further including a permissible relative deviation of said circumferential speeds which is formed using a first limit value in a direction of slower circumferential speeds of said counter-pressure cylinder in comparison to said transfer cylinder and by a second limit value in a direction of greater circumferential speeds of said counter-pressure cylinder in comparison to said transfer cylinder.

39. The device of claim 38 wherein said first limit value is formed by a deviation of −0.05% to −0.01% and in particular −0.02%.

40. The device of claim 38 wherein said second limit value is formed by a deviation of +0.05% to +0.01% and in particular +0.02%.

41. A device for driving a printing unit comprising:

at least one counter-pressure cylinder;

at least one transfer cylinder cooperating with said counter-pressure cylinder and constituting a print position;

a first drive motor usable to drive said at least one counter-pressure cylinder mechanically independently from said at least one transfer cylinder;

an electrical output of said first drive motor; and means for regulating said at least one counter-pressure cylinder in a print-on position in accordance with said electrical output which is dropping at variable circumferential speeds, and wherein said at least one transfer cylinder can be regulated in view of a presettable circumferential speed.

42. The device of claim 41 wherein a relative deviation from said circumferential speeds does not fall below a first limit value which is −0.02% toward a slower circumferential speed of said at least one counter-pressure cylinder in comparison to said at least one transfer cylinder, and does not exceed a second limit value which is +0.02% toward a higher circumferential speed of said at least one counter-pressure cylinder in comparison to said at least one transfer cylinder.

* * * * *